United States Patent [19]

Jaeger et al.

[11] 4,445,053

[45] Apr. 24, 1984

[54] SQUARE LAW CHARGER

[75] Inventors: C. René Jaeger, So. Lyndeborough, N.H.; Joseph B. Seale, Waltham, Mass.

[73] Assignee: DBX, Inc., Newton, Mass.

[21] Appl. No.: 807,234

[22] Filed: Jun. 16, 1977

[51] Int. Cl.[3] ..... G06G 7/12; G06G 7/20

[52] U.S. Cl. ..... 307/490; 307/494; 328/144

[58] Field of Search ..... 307/229, 230, 490, 494; 328/26, 143–145; 324/132

[56] References Cited

U.S. PATENT DOCUMENTS 3,539,931 11/1970 Jouve ..... 328/144

3,681,618 8/1972 Blackmer ..... 328/145

3,714,570 1/1973 Howell ..... 328/26

3,789,143 1/1974 Blackmer ..... 179/15.55 R

*Primary Examiner*—Stanley D. Miller

*Assistant Examiner*—B. P. Davis

*Attorney, Agent, or Firm*—Schiller & Pandiscio

[57] ABSTRACT

A device is described for modifying the charging behavior of a charge storage device, such as a capacitor, so that the device charges substantially in accordance with a square law function responsively to a linear charging input current. The device has particular utility in a signal-conditioning system of the type including an averaging detector, a gain stage and a charge storage device coupled between the output of said detector and the input of said gain stage so that the input to said gain stage behaves in a similar manner to the output of an RMS detector.

19 Claims, 5 Drawing Figures

SQUARE LAW CHARGER

The present invention relates to devices for modifying the charging behavior of charge storage devices and more particularly to devices for adapting otherwise incompatible program signal conditioning systems so that they are compatible with certain signal conditioning techniques.

Various signal conditioning systems and techniques are known for improving the signal-to-noise ratio of transmitted or recorded information or program signals. One technique which has proven to be worthwhile, as well as commercially successful, is generally known as the DBX encoding and decoding (companding) process. This process, which is described and claimed in U.S. Pat. No. 3,789,143 issued to David E. Blackmer on Jan. 29, 1974, generally dynamically compresses (encodes) the signal prior to transmission or recording and dynamically expands (decodes) the signal in a complementary manner, after transmission or upon playback.

More specifically, apparatus (called a compander and disclosed in the aforementioned Blackmer patent) for encoding and decoding the signal in accordance with the DBX companding technique includes a signal detector for sensing the input signal amplitude on a low-ripple RMS basis so that the output from the detector is substantially linearly related to the input level in decibels. A control amplifier is provided to set a gain change sense of either compression or expansion and provides a control signal output related to the product of the output of the RMS detector and the gain factor introduced by the amplifier. Lastly, there is provided a gain control module which amplifies or controls the decibel gain of the input signal in proportion to the control signal provided by the control amplifier.

A preferred detector which can be employed in the DBX compander is described and claimed in U.S. Pat. No. 3,681,618 issued to David E. Blackmer, on Aug. 1, 1972. Generally, the preferred detector comprises at least one bilateral converter which provides an output signal related to the instantaneous logarithm of the RMS value of the input signal, amplification means for doubling the output of the converter and means coupled to the output of the amplification means and including an antilogarithmic device and a charge storage device. The charge storage device is charged responsively to the output of the amplification means in accordance with a square law function.

With the growth and greater acceptance of compander encoded techniques in transmission and recording, compander systems are increasingly becoming available to encode and decode these signals. Various compander systems, some in IC form are now commercially available and are used as expanders, but are not necessarily compatible with all companding techniques. For example, since a DBX encoder utilizes a detector which provides an output signal related to the logarithm of the RMS value of the input signal it is preferable to use a similar type of detector when decoding or tracking the encoded signal. Some available systems, however, do not use such RMS detectors but instead use for example, either a peak detector or an averaging detector before entering the logarithm domain. When decoding signals encoded by a compressor having a peak detector, the latter senses signal peaks of the input signal to determine whether the input signal level is above or below a predetermined threshold. The effect of peak detection is that the expander acts somewhat erratically, and may expand the program when it detects a noise spike or brief signal transient that isn't really representative of the program level.

Decoding signals encoded by a compressor having an averaging detector usually involves sensing the average level of the incoming program to determine whether the signal is above or below the threshold level. Averaging detectors will not overreact on signal peaks but may respond too slowly to accurately expand a program. The decoder may respond too late to a rapid increase in program level after the actual input signal has begun to decrease again, causing an unnatural or swishing sound.

It is generally known that RMS detectors such as those employed in DBX companders will not overreact to produce more natural sounding expansion since it will not overreact to signal transients, noise spikes or changes in input level.

Thus, by way of example, the Analog Compander NE 570/571, manufactured by Signetics Corporation of Sunnyvale, Calif., is represented as being useful as a compander in audio systems. However, the operational rectifier of the Signetics compander acts as an averaging detector, in which the output current of the detector charges a charge storage device, i.e. a capacitor, to provide a signal input to a gain stage which in turn provides an output signal related to the logarithm of the averaging signal provided by the rectifier. The Signetics compander is unsuitable for tracking DBX encoded signals.

It is therefore an object of the present invention to modify the charging behavior of a charge storage device, at the output of an averaging detector so that the charging behavior is substantially similar to that provided by the output of an RMS detector.

Another object of the present invention is to provide a relatively inexpensive device for modifying the charging behavior of a charge storage device coupled between the output of an averaging detector and the input of a gain stage of a program signal-conditioning system so that the system is capable of tracking signals previously encoded with an RMS detector and gain stage.

A further and more specific object of the present invention is to provide a device for modifying the Signetics compander so that it is capable of tracking DBX encoded signals.

These and other objects of the present invention are achieved by a device which modifies the charging behavior of a charging device coupled to receive a current of the type appearing at the output of an averaging detector so that the charging behavior of the charging device is similar to that of an RMS detector.

Other objects of the invention will in part be obvious and will in part appear hereinafter. The invention accordingly comprises the apparatus possessing the construction, combination of elements and arrangement of parts which are exemplified in the following detailed disclosure and the scope of the application of which will be indicated in the claims.

For a fuller understanding of the nature and objects of the present invention, reference should be had to the following detailed description taken in connection with the accompanying drawings wherein.

Figure 1:
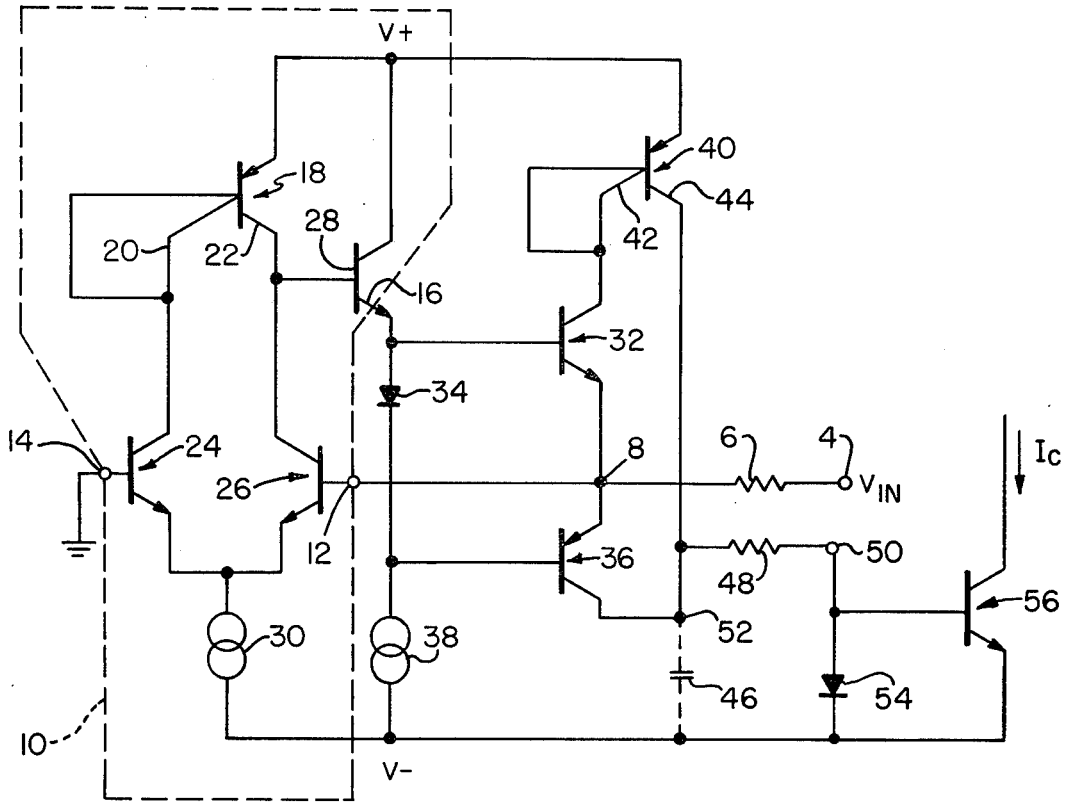
FIG. 1 is a schematic circuit drawing of an averaging detector of the type used in the in Signetics compander.

A detailed but simplified version of the prior art operational rectifier (or averaging detector) which is found in the Signetics compander is shown in FIG. 1. The input signal Vin is applied to the detector input terminal 4, through the resistor 6 and junction 8, to the inverting input 12 of operational amplifier 10. The positive input 14 of the amplifier is connected to ground so that the amplifier acts as an inverting operational amplifier in order that a positive signal input to terminal 12 provides an output signal at terminal 16 which tends to drive the signal applied to terminal 12 more negative. Operational amplifier 10 includes a current mirror 18 generally including two pnp transistors having their emitters tied together and to a positive voltage source and their bases tied together. The collector 20 of one transistor of the current mirror is connected to the collector of transistor 24, while the collector 22 of the other transistor of the current mirror is connected to the collector of transistor 26 and to the base of transistor 28. The base of transistor 24 is connected to the positive input terminal 14 of the amplifier, while the base of transistor 26 is connected to the inverting input terminal 12 of the amplifier. The emitters of transistors 24 and 26 are connected together and to the negative current source 30. The collector of transistor 28 is connected to a positive voltage source, while its emitter is connected to the output terminal 16.

The output terminal 16 is connected to the base of npn transistor 32 and the anode of the biasing diode 34, which in turn has its cathode connected to the base of pnp transistor 36 and the negative current source 38. The emitters of transistors 32 and 36 are both connected to junction 8, while the collector of transistor 32 is connected to the collector 42 of the current mirror 40. The other collector 44 of current mirror 40 is connected with the collector of transistor 36 through the junction 52 to the resistor 48 and capacitor 46. The resistor in turn is connected to output terminal 50 of the rectifier. The output terminal 50 provides a rectified current to the input of a gain stage, and specifically to the anode of diode 54 and the base of transistor 56 of the stage.

In operation, where the signal applied to the input terminal 4 of the operational rectifier is at a zero level (such as at a zero-axis crossing or when in a quiescent state) the current mirror 18, as well as the transistors 24 and 26 of the operational amplifier are all forward biased and an equal amount of current flows through each of the collectors 20 and 22 of the current mirror. Of the current flowing through collector 22, a portion flows through the collector-emitted path of transistor 26 and a portion is applied to the base of transistor 28. The currents flowing through the emitters of transistors 24 and 26 are equal to the current provided by the current source 30 (the latter current being constant). Transistor 28 functions as an emitter-follower current amplifier, whereby a change in base voltage produces a change in the emitter voltage. In this state the current flowing through the collector-emitter path of transistor 28, and more particularly the voltage of the output of the amplifier 10, is insufficient to bias both of the transistors 32 and 36 on.

When the signal, Vin, at terminal 4 is of a positive polarity, a positive input is provided to the input terminal 12 of the operational amplifier 10. This results in an increase in the current flowing through the collector-emitter path of transistor 26. Since the current from source 30 remains constant, an increase in current through transistor 26 will produce a corresponding decrease in current through transistor 24 so as to decrease the current from the collector 20 of the mirror 18. This produces a corresponding decrease in current flowing through the collector 22. The combination of the decrease in current flowing through collector 22 and the increase in current through transistor 26 results in a decrease in current applied to and the voltage level of the base of transistor 28. Since transistor 28 functions as an emitter-follower current amplifier, a decrease of base voltage results in a decrease in voltage and current output from terminal 16. This decrease in voltage and current together with the signal level at junction 8 going positive results in transistor 32 remaining nonconductive and transistor 36 becoming forward biased. Current flow is provided from junction 8 through the emitter-collector path of transistor 36 to junction 52, where it positively charges capacitor 46 in accordance with a linear function, and the voltage signal thus provided appears at the output 50 less the voltage drop provided by resistor 48.

When the input signal at terminal 4 is of a negative polarity a signal is applied to the base of transistor 26 resulting in a decrease in current flowing through transistor 26 and a complimentary increase to the base of transistor 24. This results in an increase in the current flow through the collector 20 and a corresponding increase in current through collector 22 of the current mirror 18. The combined increase of current through collector 22 and decrease of current through transistor 26 increases the current to and thus the voltage of the base of transistor 28. This causes an increase in output current of the operational amplifier 10. The increased output is applied to the base of transistor 32 so that the latter is forward biased and current flows through the collector 42 of the current mirror and the collector-emitter path of transistor 32 so as to drive the negative signal at junction 8 more positive. It is noted that transistor 36 remains nonconductive so long as the input signal at terminal 4 is of a negative polarity. As current flows through the collector 42, an equal current flows through collector 44 to the junction 52.

Thus, regardless of the polarity of the input signal, Vin, the current provided at junction 52 is a rectified current which charges capacitor 46 in accordance with a linear-function and thereby provides a voltage signal at terminal 50 which is characteristic of a signal output of an averaging detector.

In accordance with the present invention, the dynamic behavior of the charging of the capacitor 46 is modified so that it resembles substantially square law behavior. More specifically, referring to FIG. 2, one plate of the external capacitor 46A is connected to the junction 52 as previously connected in the FIG. 1 embodiment. The other plate of the capacitor 46A is connected to the inverting input of an operational amplifier 58 and to the emitter of the pnp transistor 60. The collector of transistor 60 is connected to junction 52 while the base of the transistor is connected to the current source provided by the DC voltage applied across the variable resistor 62. The base of transistor 60 is also connected to the anode of a temperature compensating diode 64, which in turn has its cathode connected to the output of operational amplifier 58. Diode 64 provides a temperature-compensating reference voltage from the reference current I bias. The positive input of amplifier 58 is set at a voltage level which is above the operating voltage range provided at the junction 52. The inverting input of the amplifier connected to the anode of diode 66. The cathode of the latter is connected to the anode of diode 68, which in turn has its cathode connected to the output of the operational amplifier so that diodes 66 and 68 form a feed-back path between the output and inverting input of operational amplifier 58 which conducts positive current from the inverting input to the output of the amplifier. A second feedback path is provided by the diode 72, which has its anode connected to the output of amplifier 58 and its cathode connected to the inverting input of the amplifier so as to conduct positive current from the output of the amplifier to the inverting input in order to drive the inverting input to the voltage level set at the positive input of the amplifier. In the preferred embodiment, diodes 66, 68 and 64 are actually transistors connected in a diode mode, and are matched with the transistor 60.

When quiescent conditions exist (the capacitor 46A is neither charging nor discharging) the voltage level at the inverting input of amplifier 58 will equal the voltage level at the output as well as the positive input of the amplifier. As previously noted, this is above the operating voltage range of the incoming rectified signal at junction 52 whose current is represented by I shown in FIG. 2. As the incoming current increases, it "charges" the capacitor 46A in a positive direction, providing a change in voltage at the inverting input of amplifier 58. This results in the output of the amplifier to go more negative. As the output goes more negative, the diodes 66 and 68 are forward biased providing a positive current from the inverting input to the output of the amplifier. The change in the voltage ouput of the amplifier will be a function of two times the logarithm of the input current applied to the inverting input of the amplifier. Thus, the negative-going change in output voltage of the amplifier is expressed as follows:

$$2 \log (Iin) \quad (1)$$

where; Iin = the current input to the negative input terminal from the capacitor 46A.

In accordance with Kirchnoff's law the voltage change in the output of the amplifier produces voltage changes in the base-emitter voltage (Vbe) of the transistor 60 and the voltage across the diode 64 (Vd) by the following relationship:

$$2 \log (Iin) = Vbe + Vd \quad (2).$$

It will be appreciated that $$Vbe = \log (Ic) \quad (3);$$

where Ic = the current flowing through the collector of transistor 60;

$$Vd = \log (I \text{ bias}) \quad (4);$$

where I bias = the current flowing through the diode 64. Therefore, equation (2) becomes $$2 \log (Iin) = \log (Ic) + \log (I \text{ bias}), \text{ or} \quad (5)$$

-continued $$Ic = \frac{Iin^2}{I \text{ bias}}, \quad (6)$$

assuming diodes 64, 66 and 68 and transistor 60 are matched.

The current generated in the collector of transistor 60 is thus a function of the output of the amplifier 58 when the capacitor 46A is charging. The capacitor is charged not only by the charging current passing through the junction 52 but also the current generated through the transistor 60. In this manner the charging behavior of the capacitor 46A is in accordance with a square law function so that it behaves more like the output of an RMS detector.

Figure 3:
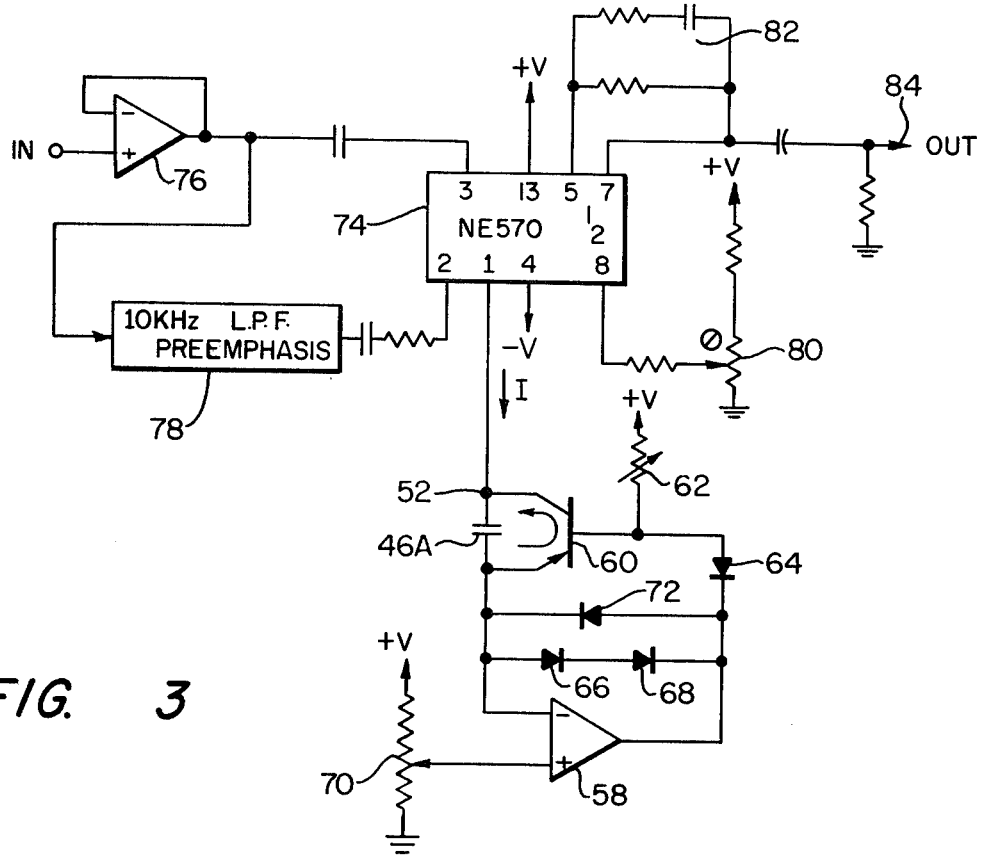
FIG. 3 is a schematic illustration of the present invention employed with the Signetics analog compander.

The teachings of the present invention can be applied to the Signetics compander as shown in FIG. 3. Specifically, the circuit is connected as shown whereby the Signetics compander, shown at 74, has its number 3 pin connected to receive the encoded input signal from the signal conditioner 76 and a control signal from a low frequency preemphasis filter 78, the latter being responsive to the output of conditioner 76. The pins 4 and 13 of the compander 74 are connected to suitable DC voltage sources (e.g. −12 volts and 12 volts, respectively) and pin 8 is connected to a trimming potentiometer 80. Pin 5 is suitably connected through the RC tank circuit 82 (and pin 7 directly) to the output 84. Connected in this manner, under typical operating conditions, the operating voltage range of the signal applied to junction 52 is below +6 volts. Thus, voltage source 70 is set above the operating voltage range, for example, +6 volts DC. Under steady state conditions, therefore, the output and the inverting input of the operational amplifier 58 will be at the level set at the positive input, i.e. +6 volts.

The device of FIG. 3 operates as follows:

When the current I is positive, the voltage applied to the capacitor increases. Since it is positive, a voltage signal above that set at the positive input of operational amplifier 58, i.e. above 6 volts, is provided at the inverting input of the operational amplifier so as to produce a negative change in the voltage at the output, i.e. a drop from 6 volts. As previously described, this change in voltage is a function of two times the logarithm of the input current. Thus, diode 64 is forward biased so that transistor 60 is conductive. The capacitor therefore discharges providing the $I^2$ current flow in the direction shown thereby providing the square law charging behavior previously described.

When the charging current I from the output of the averaging detector reaches equilibrium, i.e. it is neither positive nor negative, the output of the operational amplifier 58 is no longer below the input level at the positive input but is equal to it. Diode 64 therefore stops conducting and transistor 60 is turned off.

When the charging current I is negative, the voltage applied to the inverting input falls below the signal level at the positive input of the operational amplifier 58 so that the output signal of the amplifier increases. This generates a current from the output of the amplifier via diode 72 to its inverting input as well as to the capacitor 46A. Since this latter current is dynamic in nature, a current will be provided back to the input of the gain stage of the Signetics compander 74, i.e. to the diode 54 and the base of transistor 56.

Figure 2:
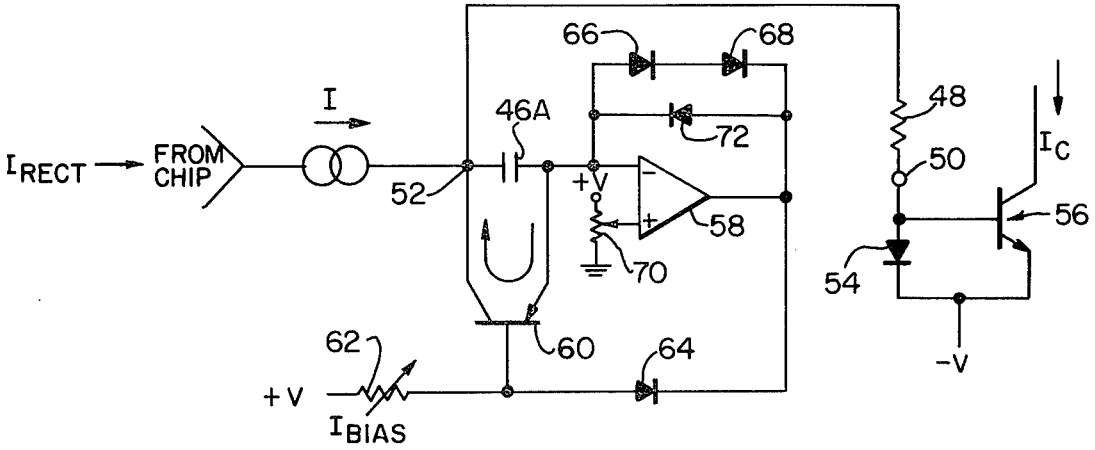
FIG. 2 is a schematic drawing of the preferred embodiment of the present invention.
Figure 4:
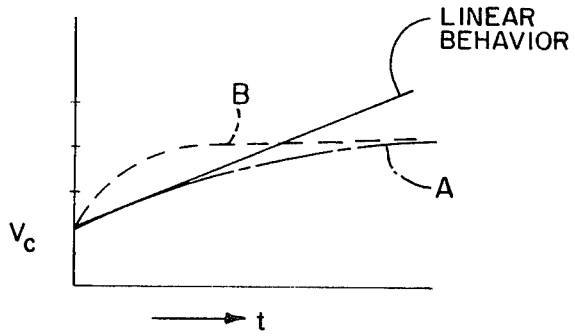
FIG. 4 is a graphical illustration showing the modifications achieved by the present invention.

As shown in FIG. 4, a current which is increasing with time, the capacitor 46 of FIG. 1 exhibits a charging behavior as shown in curve A while the capacitor 46A of FIG. 2 would exhibit charging behavior similar to curve B where the teachings of the present invention are utilized.

Figure 5:
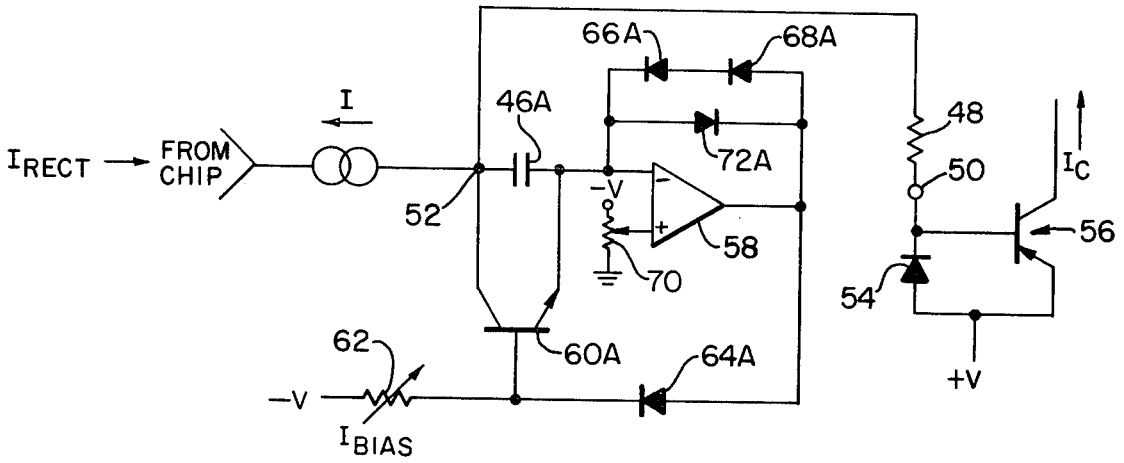
FIG. 5 is a schematic drawing of modification of the present invention. In the drawings, the same numerals are used to denote like parts.

It will be appreciated that several modifications may be made to the present invention. For example, as shown in FIG. 5, where the input signal is rectified in a negative sense (i.e. the rectified current increases in a negative sense with an increase in the input signal in a positive sense), the connections of the diodes 64A, 66A, 68A and 72A are reversed from the corresponding elements of the circuit of FIG. 2 and an npn transistor 60A is substituted for the pnp transistor 60. In the latter case, the collector and emitter of the npn transistor is connected in the same manner, i.e. the collector connected to junction 52 and the emitter to the output of capacitor 46A. Also, the positive input terminal of amplifier 58 is set at a voltage level more negative than the expected ranges of voltages of the signals received at junction 52. Further, a differential amplifier can be used as amplifier 58 in which case the positive input of the amplifier should be set at a level more positive than the expected ranges in the FIG. 2 embodiment and more negative than the expected ranges of input voltage in the FIG. 5 embodiment.

The invention thus described has several advantages. The circuit is inexpensive and easily realized in integrated circuit form. The device provides a relatively inexpensive device for modifying the output signal of an averaging detector so that it appears to behave in a manner similar to an RMS detector for the purposes of tracking a previously compressed signal, particularly those compressed in accordance with a DBX signal conditioning technique.

Since certain changes may be made in the above apparatus without departing from the scope of the invention herein involved, it is intended that all matter contained in the above description or shown in the accompanying drawings shall be interpreted as illustrative and not in a limiting sense.

What is claimed is:

1. In a system for charging a charge storage device with an input current due to an input signal, the improvement comprising:

a current conducting loop coupled between the output and input of said charge storage device and means for varying the loop current in said current conducting loop so that said charge storage device is charged by said input current and loop current substantially in accordance with a function of the square of said input current.

2. In the system of claim 1 wherein said means for varying the loop current in said current conducting loop includes signal generating means for generating a control signal responsively to an output signal of said charge storage device when said charge storage device is charging and wherein said current conducting loop includes means responsive to said control signal for generating said loop current.

3. In the system of claim 2 wherein said signal generating means comprises operational amplification means for providing said control signal, said control signal being logarithmically related to said output signal of said charge storage device.

4. In the system of claim 3 wherein means for generating said loop current comprises a transistor having its emitter and collector coupled between the output and input of said charge storage device and its base connected to receive said control signal.

5. In the system of claim 3 wherein said operational amplification means comprises an inverting input and an output and a feedback path including two current conductive elements connected between said output and inverting input of said operational amplification means, wherein each of said current conductive elements has a logarithmic voltage versus current characteristic so that said control signal is related to two times the logarithm of said output signal of said device.

6. In the system in accordance with claim 5 wherein said operational amplification means further comprises a differential amplifier.

7. In the system in accordance with claim 5 wherein said operational amplification means further comprises a positive input set at a voltage level more positive than the expected ranges of voltages of said input signal and a second feedback path including unidirectional current conduction means coupled between said inverting input and output of said operational amplification means.

8. In the system of claim 7 wherein said first feedback path only conducts positive current from said inverting input to said output of said operational amplification means and said second feedback path only conducts positive current from the output to said inverting input of said operational amplification means.

9. In a signal-conditioning system of the type including an averaging detector, a gain stage and a charge storage device coupled between the output of said detector and the input of said stage so that said device is charged by a current due to the output signal of said averaging detector, the improvement comprising:

means for modifying the charging behavior of said charge storage device so that said device charges responsively to said current from said detector in accordance with a function of the square of said current.

10. In the system of claim 9 wherein said means for modifying the charging behavior of said charge storage device comprises a current conducting loop coupled between the output and input of said charge storage device and means for varying the loop current in said current conducting loop to effect charging of said charge storage device substantially in accordance with a function of the square of said input current.

11. In the system of claim 10 wherein said means for varying the loop current in said current conducting loop includes signal generating means for generating a control signal responsively to the output signal of said charge storage device when said charge storage device is charging and wherein said current conducting loop includes means responsive to said control signal for generating said loop current.

12. In the system of claim 11 wherein said signal generating means comprises operational amplification means for providing said control signal, said control signal being logarithmically related to said output signal of said charge storage device.

13. In the system of claim 12 wherein means for generating said loop current comprises a transistor having its emitter and collector coupled between the output and input of said charge storage device and its base connected to receive said control signal.

14. In the system of claim 12 wherein said operational amplification means comprises an inverting input and an output and a feedback path including two current conductive elements connected between said output and inverting input of said operation amplification means wherein each of said current conductive elements has a logarithmic voltage versus current characteristic so that said control signal is related to two times the logarithm of said output signal of said device.

15. In the system in accordance with claim 14 wherein said operational amplification means further comprises a differential amplifier.

16. In the system in accordance with claim 14 wherein said operational amplification means further comprises a positive input set at a voltage level more positive than the expected ranges of voltages of said output signal of said detector and a second feedback path including unidirectional current conduction means coupled between said inverting input and output of said operational amplification means.

17. In the system of claim 16 wherein said first feedback path only conducts positive current from said inverting input to said output of said operational amplification means and said second feedback path only conducts positive current from the output to said inverting input of said operational amplification means.

18. In the system of claim 5 wherein said operational amplification means further comprises a positive input set at a voltage level more negative than the expected ranges of voltages of said input signal and a second feedback path including unidirectional current conduction means coupled between said inverting input and output of said operational amplification means, and said first feedback path only conducts positive current from the output to said inverting input of said operational amplification means, and said second feedback path only conducts positive current from said inverting input to said output of said operational amplification means.

19. In the system of claim 14 wherein said operational amplification means further comprises a positive input set at a voltage level more negative than the expected ranges of voltages of said output signal of said detector and a second feedback path including unidirectional current conduction means coupled between said inverting input and output of said operational amplification means, and said first feedback path only conducts positive current from the output to said inverting input of said operational amplification means and said second feedback path only conducts positive current from said inverting input to said output of said operational amplification means.

* * * * *

UNITED STATES PATENT AND TRADEMARK OFFICE

CERTIFICATE OF CORRECTION

PATENT NO. : 4,445,053

DATED : April 24, 1984

INVENTOR(S) : C. Rene Jaeger

It is certified that error appears in the above-identified patent and that said Letters Patent is hereby corrected as shown below:

Claim 14, column 9, line 2, delete "operation" and substitute therefor -- operational --.

Signed and Sealed this

*Twenty-eighth* Day of *August 1984*

[SEAL]

*Attest:*

GERALD J. MOSSINGHOFF

*Attesting Officer*

*Commissioner of Patents and Trademarks*